United States Patent [19]

Shinohara et al.

[11] Patent Number: 4,968,860

[45] Date of Patent: Nov. 6, 1990

[54] LIGHT EMITTING TYPE PUSH BUTTON SWITCH

[75] Inventors: Kenji Shinohara, Ibaraki; Takashi Niwa, Kyoto, both of Japan

[73] Assignee: Omron Tateisi Electronics Co., Kyoto, Japan

[21] Appl. No.: 353,685

[22] Filed: May 18, 1989

[30] Foreign Application Priority Data

May 19, 1988 [JP] Japan ..... 63-122294[U]
May 24, 1988 [JP] Japan ..... 63-68223
May 25, 1988 [JP] Japan ..... 63-129391

[51] Int. Cl.[5] ..... H01H 9/00
[52] U.S. Cl. ..... 200/314; 200/345
[58] Field of Search ..... 200/314, 313, 310, 317, 200/341, 345

[56] References Cited

U.S. PATENT DOCUMENTS 3,701,064 10/1972 Kinoshita et al. ..... 200/345
4,242,545 12/1980 Schweitzer ..... 200/314
4,346,275 8/1982 Iwakiri et al. ..... 200/314
4,447,685 5/1984 Ohashi et al. ..... 200/314
4,488,020 12/1984 Zalewski et al. ..... 200/314
4,585,914 4/1986 Ohashi et al. ..... 200/314
4,694,130 9/1987 Kitzman et al. ..... 200/314
4,751,385 6/1988 Van Benthusysen et al. ..... 200/314
4,816,630 3/1989 Honda et al. ..... 200/314
4,851,623 7/1989 Honda et al. ..... 200/314
4,908,485 3/1980 Honda et al. ..... 200/314
4,910,368 3/1990 Honda et al. ..... 200/314

*Primary Examiner*—Henry J. Recla
*Assistant Examiner*—Keith Kupferschmid
*Attorney, Agent, or Firm*—Wegner & Bretschneider

[57] ABSTRACT

A light emitting type push button switch having an indication unit including an operation block containing an indicator and a switch unit having a microswitch turned on or off by the pushing of the operation block through a plunger axially movably held in the case of the indication unit, the indication unit and switch unit which can be easily engaged with each other or disengaged from each other.

8 Claims, 18 Drawing Sheets

| | |
|---|---|
| Fig. 11(a) | Fig. 11(b) |

LIGHT EMITTING TYPE PUSH BUTTON SWITCH

BACKGROUND OF THE INVENTION

1. Field of the Invention

The present invention relates to a light emitting type push button switch mounted on a control panel.

2. Description of Related Art

This kind of switch comprises an indication unit and a switch unit removably connected to each other. The indication unit has an operation block containing an indicator. The switch unit has a microswitch which is turned on or off by the pushing of the operation block through a plunger held to be longitudinally movable in the case of the indication unit.

Referring to FIG. 23, a known construction of the indication unit and the switch unit which are connected to each other is described hereinbelow. An approximately T-shaped engaging projection 202 is formed on the indication unit 201, and as shown in FIG. 24, a plurality of a pair of elastic arms 206 and 207 connected by a rectangular pressure applying plate 205 are formed on the front of a microswitch 204, and as shown in FIG. 25, a pair of engaging projections 208 and 209 which removably engage with both sides of the engaging projections 202 is formed on the inner wall of the pressure applying plate 205.

However, since the elastic arms 206 and 207 are disposed on the front of the microswitch 204 of the switch unit 203, the elastic arms 206 and 207 and the pressure applying plate 205 which are connected with the indication unit 201 are disposed between the indication unit 201 and the switch unit 203. Therefore, the switch is long lengthwise, i.e., it is difficult to manufacture a compact switch.

In particular, since this construction does not allow the formation of the long elastic arms 206 and 207, the flexible amount of the elastic arms 206 and 207 is small, and the switch unit 203 and the indication unit 201 cannot be easily engaged with each other or disengaged from each other by the pressure applying plate 205. Therefore, when a great force is applied to the button, the elastic arms 206 and 207 may be damaged.

Since the elastic arms 206 and 207 are formed on the pressure applying plate 205, the space of the pressure applying plate 205 is comparatively large. But, the provision of the small pressure applying plate 205 makes it difficult to engage the switch unit 203 and the indication unit 201 with each other or disengage them from each other.

If the external terminals 211 of the microswitch 204 and the terminals 211 for connecting the indicator to the switch unit are provided with screws, both external terminals are cylindrically formed and a male screw is screwed into a nut formed on the end face of each of the cylindrical terminals. In this case, it is necessary for the switch case to have two configurations, which leads to the preparations of increased number of metal molds.

SUMMARY OF THE INVENTION

The present invention has been made to overcome the above-described disadvantage of the known light emitting type push button switch. Accordingly, it is an object of the present invention to provide a compact light emitting type push button switch having an indication unit and a switch unit which can be easily engaged with each other or disengaged from each other.

It is another object of the present invention to provide a light emitting type push button switch in which a switch case can be manufactured easily and the external terminal of the microswitch and the external terminal for connecting the indicator to the switch unit are composed of a frame or provided with a screw.

It is still another object of the present invention to provide a microswitch in which the stroke of the button is long and which can be easily assembled.

The light emitting type push button switch in accordance with the present invention has an indication unit including an operation block containing an indicator and a switch unit having a microswitch turned on or off by the pushing of the operation block through a plunger axially movably held in the case of the indication unit comprises a plurality of approximately C-shaped engaging projections formed on the rear end portion of the indication unit; a plurality of elastic arms formed on the switch cover of the switch unit so as to correspond to the engaging projections and extending from the rear end of the side wall of the switch cover to the front end thereof; a locking projection formed on the front end of each of the elastic arms and removably engaging with the inner surface of the corresponding C-shaped engaging projection; and a T-shaped pressure applying plate formed on the peripheral surface of the locking projection.

According to this construction, since the elastic arms which engage with the approximately C-shaped engaging projections of the indication unit are formed integrally with the side wall of the switch cover of the switch unit, the elastic arms and the C-shaped engaging projections are connected on the side of the switch unit. Therefore, the push button switch is longitudinally short and both units can be favorably connected to or disconnected from each other. Further, the portions at which both units are connected to each other are not damaged. Further, the great area of the pressure applying face which is T-shaped enables a pressure applying operation to be performed easily.

It is a further object of the present invention to provide a light-emitting push button switch having an indication unit and a switch unit comprising the switch case of the switch unit which comprises a switch base and a pair of switch covers mounted on both sides of the switch base; a concave portion, provided in at least one of the switch covers, to accommodate a microswitch in cooperation with the switch base; an external terminal to which a connection terminal, for connecting the indicator of the indication unit to the switch unit is removably connected, is fixed to the switch base; a plurality of elastic arms having on each of the front end portions thereof a locking projection which removably engages with a corresponding engaging projection of a plurality of engaging projections formed on the indication unit; and a pressure applying plate, for disengaging the locking projection and the engaging projection from each other, formed on and integral with the peripheral surface of each of the elastic arms.

According to this construction, the switch case comprises the switch base and a pair of the switch covers mounted on both sides of the switch base, and the concave portions are formed in the switch covers to accommodate the microswitch in cooperation with the switch base, i.e., the switch unit comprises three parts, and a pair of the elastic arms and locking projections are formed on the switch base. Accordingly, the moldings of the switch base and the switch covers are facilitated and the switch case can be easily assembled with the microswitch accommodated in one of the concave portions.

Further, each of the rear ends of the external terminals mounted on the microswitch is bent to be L-shaped to be disposed in contact with the switch cover, and each of the rear ends of the external terminals fixed to the switch base to which each of the indicator connecting terminals of the switch unit is removably connected is bent to be L-shaped to be disposed in contact with the switch base, and the terminal portion provided with a screw is formed on the bent portions of each of the external terminal portions. Owing to this construction, the external terminal of a frame construction can be modified to the terminal provided with the screw.

It is a further object of the present invention to provide a microswitch comprising a switch case to which a common terminal and at least one fixed terminal are mounted on the lower wall thereof; an opening formed on the upper wall of the switch case and disposed between the common terminal and the fixed terminal; a push button vertically movably inserted into the opening; a movable plate having on the free end portion thereof a movable contact which confronts a fixed contact fixed to the inner end portion of the fixed terminal and whose base portion is pivotally mounted on the inner portion of the common terminal; a lever whose base portion is pivotally mounted on the inner end portion of the common terminal and driven by the push button; a compression spring whose one end portion is pivotally mounted on a groove formed on the lever and whose other end portion is engaged by the free end portion of the movable plate; and a shoulder formed on the lever and disposed in the vicinity of the lower portion of the groove so as to prevent the compression spring from falling from the lever.

According to this construction, the movable plate is driven by the lever driven by the push button and the compression spring suspended by the lever and the movable plate. Therefore, even though the microswitch is compact, the stroke of the lever can be long, so that the microswitch can be automatically assembled with ease. In particular, the shoulder formed on the lever prevents the compression spring from falling from the lever even though a vibration or a shock is imparted to the microswitch when it is being assembled, thereby contributing to the easy assembling of the microswitch.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
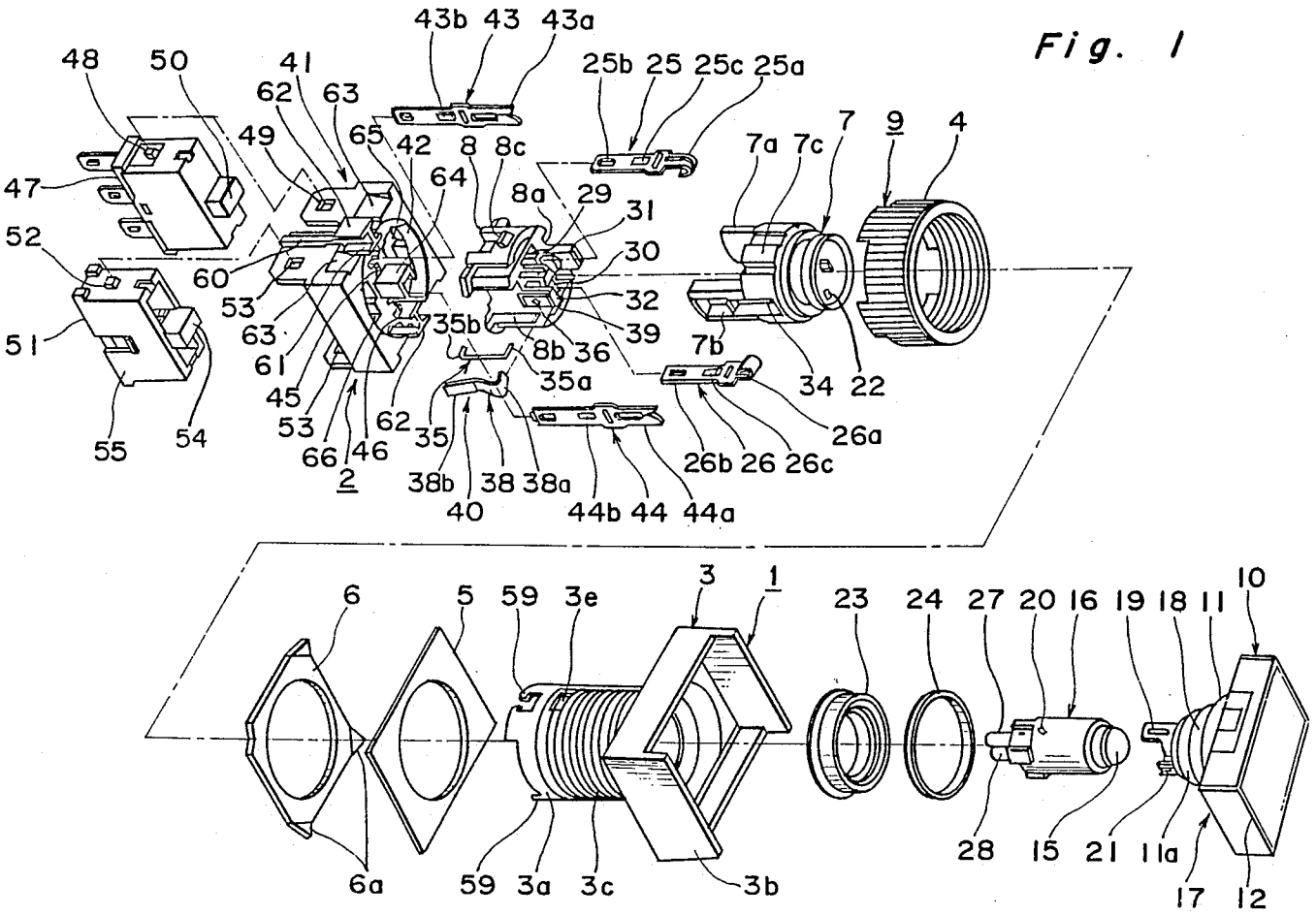
FIGS. 1, 2, and 3 are a perspective view, a partly broken front view, and a partly broken side elevational view showing a first embodiment of a light emitting type push button switch in accordance with the present invention.

Before the description of the present invention proceeds, it is to be noted that like parts are designated by like reference numerals throughout the accompanying drawings.

Figure 2:
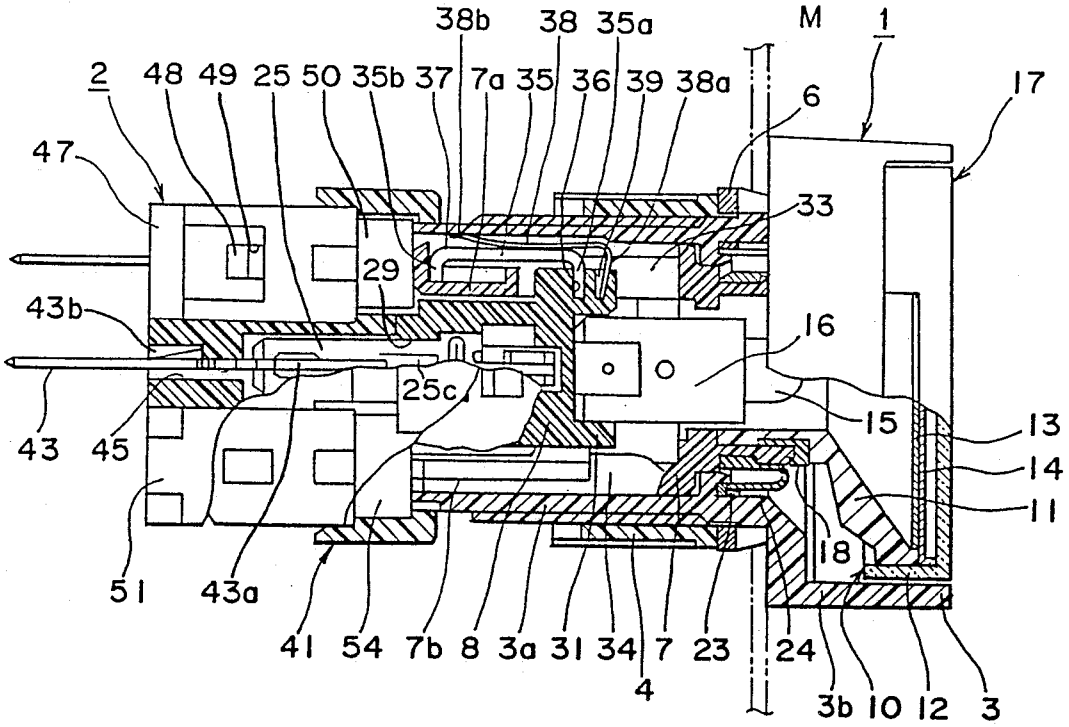
Figure 3:
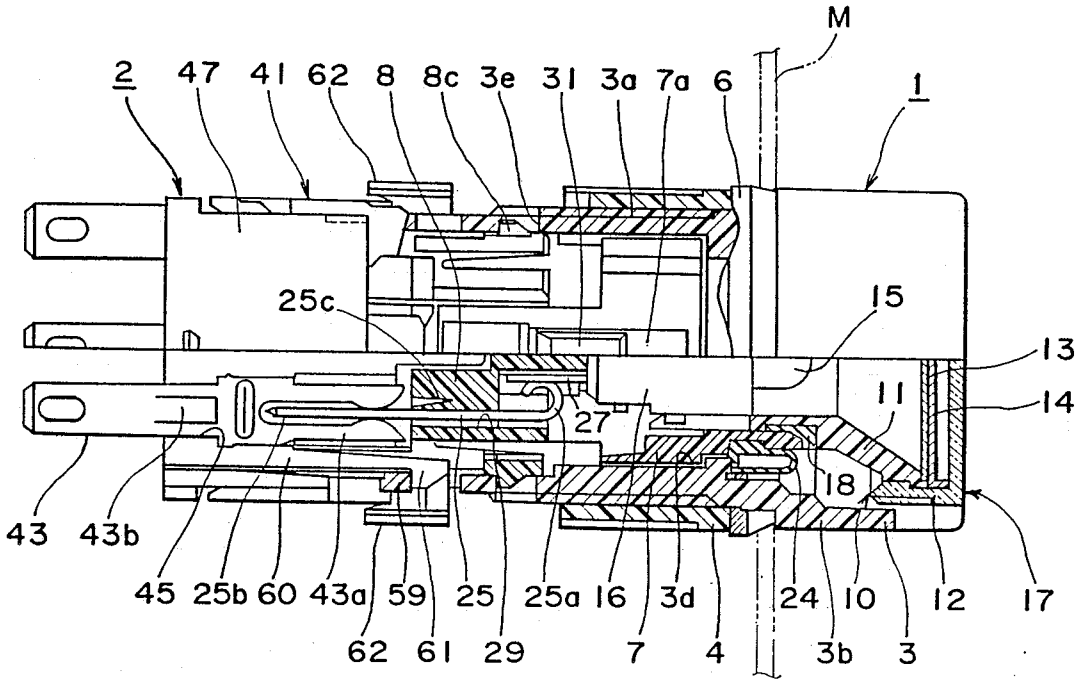

Referring now to the drawings, and in particular to FIGS. 1, 2, and 3, there is shown a first embodiment of a light emitting type push button switch in which FIG. 1 is an exploded perspective view, FIG. 2 is a partly broken front view, and FIG. 3 is a partly broken side elevational view.

As shown in FIGS. 1, 2, and 3, the light emitting type push button switch comprises an indication unit 1 and a switch unit 2.

In the indication unit 1, a case 3 made of a synthetic resin comprises a cylindrical drum 3*a* and a rectangular front frame 3*b* formed integrally with the cylindrical drum 3*a*. There is formed on the peripheral surface a screw portion 3*c* which is screwed by a ring 4. The cylindrical drum 3*a* is inserted into a washer 5 and a rectangular rotation locking metal fitting 6 on which rotation locking projections 6*a* are formed at the corners thereof.

A cylindrical plunger 7 made of a synthetic resin has a pair of operation legs 7*a* and 7*b* which are axially movably held in the cylindrical drum 3*a* of the case 3. Referring to FIGS. 1 and 3, a projected guide rail 7*c* formed on the peripheral surface of the plunger 7 in the axial direction thereof engages with a groove 3*d* formed on the inner surface of the cylindrical drum 3*a*. A locking claw 8*c* formed on the peripheral surface of an electric insulating base 8 made of a synthetic resin is fitted into an engaging opening 3*e* formed on the cylindrical drum 3*a*. The electric insulating base 8 has on the peripheral surface thereof notches 8*a* and 8*b* which do not prevent a pair of the operation legs 7*a* and 7*b* from moving. A block 9 of the indication unit 1 comprises the case 3, the plunger 7, and the base 8.

A push button 10 which is fitted in the front frame 3*b* of the case 3 comprises a funnel-shaped button 11 serving as a reflector and a light transmitting cap 12 disposed on the front end of the push button 11. A light diffusing plate 13 and a light transmitting plate 14 are accommodated inside the cap 12. A light emitting element 15, for example, a light emitting diode emits a light to the front face of the push button 10. An indicator 16 containing the light emitting diode 15 axially movably held by the base portion 11*a* of the button 11 and the push button 10 constitute an operation block 17. A rubber ring 18 is mounted on the base portion 11*a* of the button 11. A pin 20 which is fitted into a guide opening 19 formed on the button 11 is formed on the peripheral surface of the indicator 16. A Ω-shaped connection member 21 projectingly formed on the base portion of the button 11 removably engages with a connection pin 22 formed on the inner circumferential face of the plunger 7, whereby the operation block 17 and the plunger 7 are connected to each other.

A rubber seal 23 is interposed between the case 3 and the plunger 7 of the indication unit 1. A ring 24 serves as a means for fixing the rubber seal 23 to the case 3.

Figure 9:
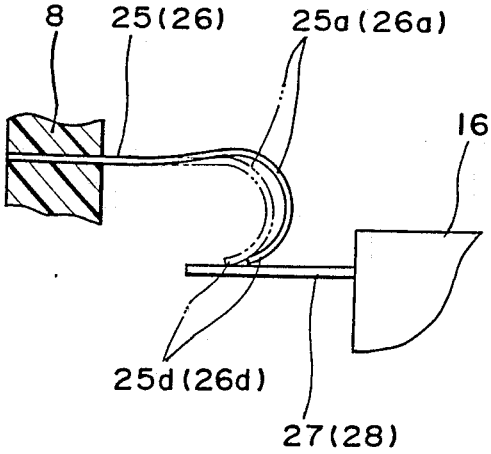
FIG. 9 is an explanatory view for explaining the operation of the indication unit-connecting terminal of the light emitting type push button switch.

A pair of connection terminals 25 and 26 for connecting the indicator to the switch unit 2 is fixedly mounted on the base under pressure. Each of the front ends 25*a* and 26*a* of the connection terminals 25 and 26 is composed of a conductive leaf spring, respectively and the front portion thereof is curved as shown in FIG. 9, thus contacting with the pair of lead terminals 27 and 28 of the indicator 16. As shown in FIG. 3, the rear end portions 25*b* and 26*b* of the connection terminals 25 and 26 project rearward from the base 8. Engaging portions 25*c* and 26*c* formed on the connection terminals 25 and 26 are locked by terminal inserting openings 29 and 30 formed on the base 8, respectively.

Projections 31 and 32 formed on the base 8 which guide the movements of the operation legs 7*a* and 7*b* of the plunger 7 are fitted in the elongated openings 33 and 34, respectively formed on the operation legs 7*a* and 7*b*.

Figure 10:
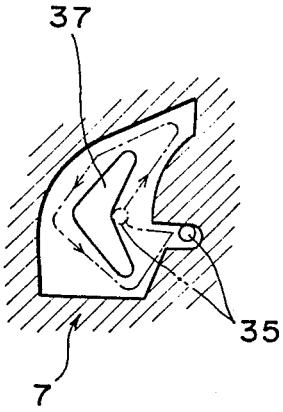
FIG. 10 is an explanatory view for explaining the alternate operation of the light emitting type push button switch.

One end portion 35*a* of ]-shaped locking wire 35 is pivotally mounted in the small opening 36 formed on the projection 32 and the other end portion 35*b* thereof moves around the cam portion 37 formed on the operation leg 7*b* of the plunger 7, thus performing the known alternate operation as shown in FIG. 10. The base portion 38*b* of a leaf spring 38 is fixed to the inner surface of the case 3 and the top end portion 38*a* thereof is locked by the opening 39 of the projection 32 so as to elastically bring the end portion 35*a* one end portion 35*a* of the locking wire 35 is prevented from being pulled out of the small opening 39 of the projection 32. The alternate mechanism 40 comprises the locking wire 35 and the cam portion 37.

A concave portion 42 in which the base 8 is fitted is formed on a box-shaped switch cover 41 made of a synthetic resin when switch unit 2 and the indication unit 1 are connected to each other. A pair of external terminals 43 and 44 for connecting the indicator to the switch unit 2 are fixed under pressure to terminal inserting openings 45 and 46 formed on the bottom surface of the concave portion 42. The connection terminals 25 and 26 are inserted into forked socket portions 43*a* and 44*a* disposed on the front ends of the external terminals 43 and 44, respectively. The engaging portions 43*b* and 44 *b* formed on the external terminals 43 and 44, respectively are locked by the terminal inserting openings 45 and 46, respectively so that the external terminals 43 and 44 are not pulled out of the terminal inserting openings 43 and 44.

A projection 48 formed on the peripheral surface of a microswitch 47 is fitted into an opening 49 formed on the switch cover 41 so as to connect the switch cover 41 and the microswitch 47 to each other. An operation lever 50 formed on the microswitch 47 is driven by the operation leg 7*a* of the plunger 7. A projection 52 formed on the peripheral surface of a dummy switch 51 disposed alongside of the microswitch 47 is fitted into an opening 53 formed on the switch cover 41 so as to connect the switch cover 41 and the dummy switch 51 to each other. An operation lever 54 formed on the dummy switch 51 is driven by the operation leg 7*b* of the plunger 7.

Figure 7:
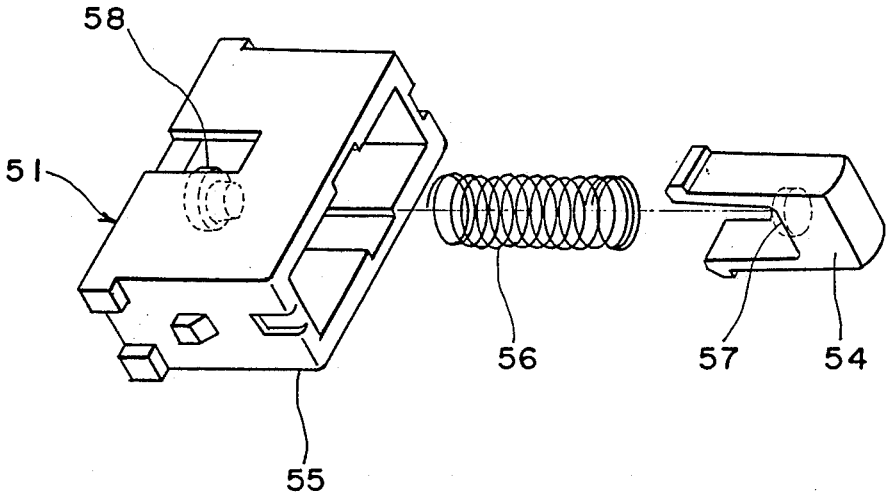
FIG. 7 is a perspective view showing a dummy switch of the light emitting type push button switch.

As shown in FIG. 7, in the dummy switch 51, the operation lever 54 is elastically supported by a coil spring 56 accommodated in the case 55. The resilience of the coil spring 56 is approximately the same as that of the spring accommodated in the microswitch 47. Spring seats 57 and 58 are mounted in the operation lever 54 and the case 55, respectively. The switch unit 2 comprises the switch cover 41, the microswitch 47, and the dummy switch 51.

Figure 4A:
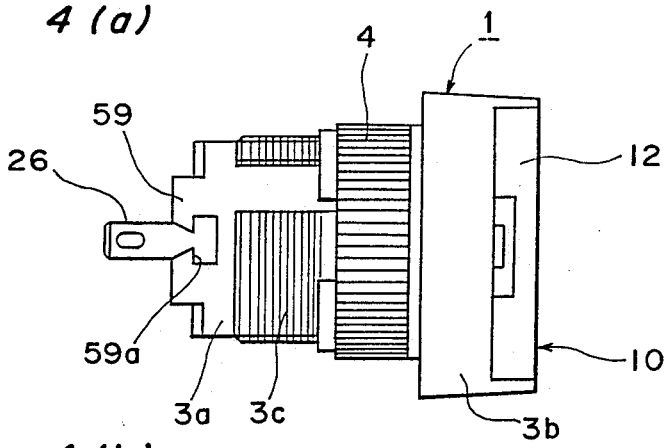
FIGS. 4(A) and 4(B) are a front view and a side elevational view showing the indication unit of the light emitting type push button switch.
Figure 4B:
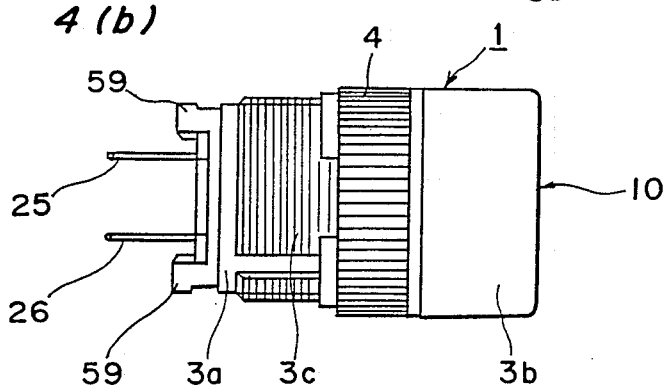
Figure 5A:
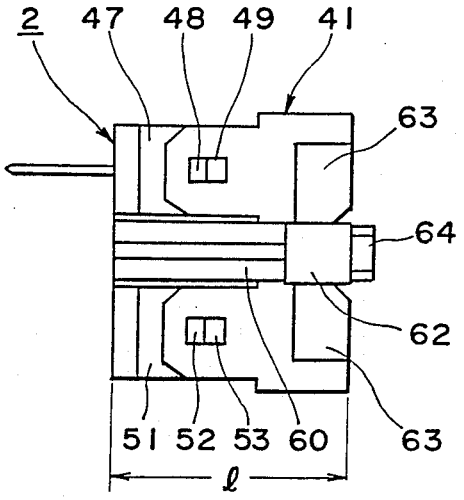
FIGS. 5(A) and 5(B) are a plan view and a front view showing the switch unit of the light emitting type push button switch.
Figure 5B:
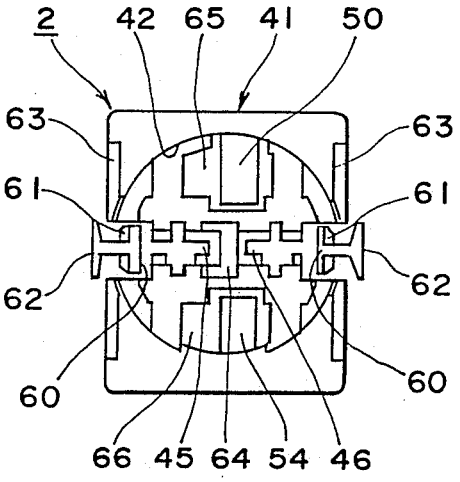
Figure 6:
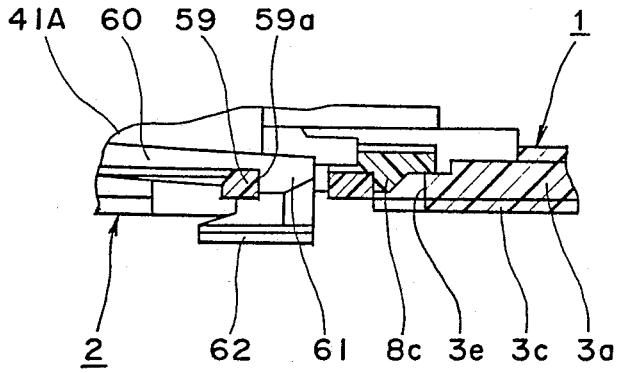
FIG. 6 is a sectional view showing the portion in which the indication unit and the switch unit of the light emitting type push button switch are connected with each other.

As shown in FIGS. 4(A) and 4(B), in the indication unit 1, two approximately C-shaped engaging projections 59 and 59 are formed on the peripheral face of the drum portion 3*a* of the case 3 so that the engaging projections 59 and 59 are symmetrical with respect to the center of a circle corresponding to the circumference of the drum portion 3*a*. Referring to FIGS. 5(A) and 5(B), elastic arms 60 are formed integrally with the switch cover 41 from the rear end to the front end thereof and disposed between the microswitch 47 and the dummy switch 51. As shown in FIG. 6, a locking projection 61 disposed on the top end of each of the elastic arms 60 removably engages with the inner surface of the engaging projection 59. Further, a T-shaped pressure applying plate 62 for disengaging the locking projection 61 and the engaging projection 59 from each other is integrated with the locking projection 61 on the front end of each of the elastic arms 60. As shown in FIG. 5(B), rectangular faces 63 are formed on both sides of the pressure applying plate 62 and on the surfaces of the switch cover 41.

A base positioning wall 64 is projectingly formed in the concave portion 42 of the switch cover 41. The operation levers 50 and 54 move into the openings 65 and 66, respectively formed in the concave portion 42.

The operation of the light emitting push button switch having the above-described construction is described hereinbelow.

The ON/OFF operation of the microswitch 47 to be performed by the pushing of the push button 10 is the same as that of the known microswitch. That is, the pushing of the push button 10 drives the plunger 7 in the axial direction thereof, with the result that the microswitch 47 and the dummy switch 51 are driven by the operation legs 7*a* and 7*b*, respectively and the microswitch 47 is turned on (off). At this time, as shown in FIG. 10, the movement of the operation leg 7*a* of the plunger 7 displaces the end portion 35*b* of the locking wire 35 from the pushed position shown by a solid line to the push-releasing position, shown by a dotted line, at which the end portion 35*b* is locked by the cam portion 37. As a result, the microswitch 47 is maintained to be ON (OFF).

When the push button 10 is pushed again, the end portion 35*b* of the locking wire 35 is dislocated from the push releasing position and moves around the cam portion 37. As a result, the microswitch 47 is turned off (on) and the plunger 7 is returned to the original position by the returning force of the operation lever 50.

That is, every time the push button 10 is pushed, the microswitch 47 is turned on or off according to the alternate movement of the locking wire 35.

As described previously, the indication unit 1 and the switch unit 2 are connected to each other by the engagement of the engaging projection 59 of the indication unit 1 and the locking projection 61 of the switch unit 2.

Since the elastic arm 60 on which the locking projection 61 is formed is integrated with the side wall, namely, the upper and lower walls of the switch cover 41 of the switch unit 2 as shown in FIG. 5(B), the indication unit 1 and the switch unit 2 are connected to each other on the side of the switch cover 41. Owing to this construction, the microswitch 47 and the dummy switch 51 can be disposed in the vicinity of the indication unit 1. In other words, the push button switch can be short in the longitudinal direction thereof, i.e., a compact push button switch can be manufactured. In this example, since the elastic arm 60 is interposed between the microswitch 47 and the dummy switch 51, the space therebetween can be effectively utilized, which contributes to the manufacture of a compact switch as well.

In particular, as shown in FIG. 5(A), the length of the elastic arm 60 is formed to be approximately the same as that (l) of the switch cover 41. Therefore, the flexible amount of the elastic arm 60 can be great, so that the locking projection 61 and the engaging projection 59 can be easily engaged with each other and disengaged from each other. Further, since the pressure applying plate 62 is T-shaped and the area thereof can be great, the locking projection 61 and the engaging projection 59 can be easily disengaged from each other.

Furthermore, since the rectangular faces 63 are formed on both sides of the pressure applying plate 62 of the switch cover 41, the push amount of the pressure applying plate 62 can be appropriately adjusted.

Figure 8:
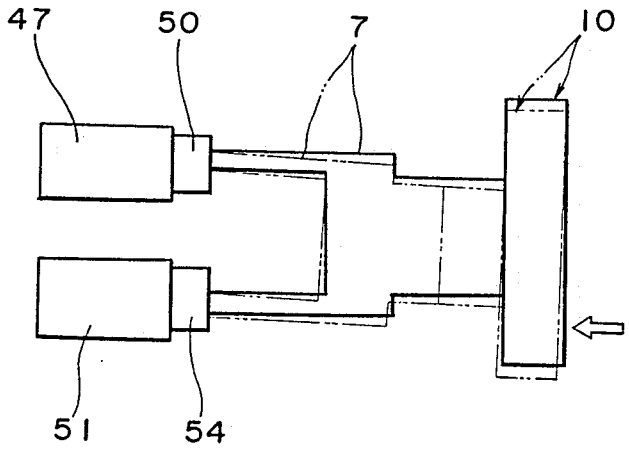
FIG. 8 is an explanatory view for explaining the operation to be performed when the dummy switch is not used.

Supposing that the switch unit 2 comprises only the microswitch 47 and that the button 10 is pushed from the upper or lower portion thereof, a tilting as shown in FIG. 8 occurs, which may cause the malfunction of the microswitch 47. Heretofore, a coil spring is interposed between a plunger and a base corresponding to the plunger 7 and the base 8, respectively so as to overcome the above-described tilting.

However, according to a known push button switch provided with the coil spring, when the operation block of an indication unit corresponding to the indication unit 1 is removed for a maintenance from a case corresponding to the case 3, the insulating distance in the push button switch becomes short.

In order to solve this problem, according to the first embodiment, the dummy switch 51 including the coil spring having the resilience which is the same as that of the spring accommodated in the microswitch 47 is disposed alongside of the microswitch 47. Accordingly, even though the center of the push button 10 is not pushed, the tilting as shown by the chain line in FIG. 8 does not occur, i.e., the microswitch 47 can be appropriately operated. In other words, the push button switch in accordance with the present invention eliminates the need for the provision of the coil spring conventionally used. Therefore, the insulating distance can be long, so that the maintenance work can be safely accomplished.

According to the first embodiment, as shown in FIG. 9, the leaf spring 25*a* (26*a*) which composes the front portion of the connection terminal 25 (26) is curved and disposed along the lead terminal 27 (28) of the indicator 16 so as to allow the top end 25*d* of the leaf spring 25*a* to contact with the lead terminal 27 (28). Owing to this construction, curved portion of the leaf spring 25*a* (26*a*) is deformed as shown in FIG. 9 as a result of the insertion of the indicator 16 into the leaf spring 25*a* (26*a*). As a result, the point which the leaf spring 25*a* (26*a*) and the lead terminal 27 (28) contact with each other is displaced from the position shown by the dashed line to the base portion of the lead terminal 27 (28) shown by the solid line. Thus, this construction ensures the connection of the indication unit 1 and the switch unit 2.

It is possible to dispose the connection terminals 25 and 26 inside the indication unit 1 and project the respective front ends 43*a* and 44*a* of the external terminal 43 and 44 from the switch unit 2 toward the indication unit 1. In this case, however, the wiring from the switch unit 2 to the indication unit 1 cannot be performed. Therefore, the indication unit 1 cannot used as an indication lamp.

According to the construction of the first embodiment, since the respective rear ends 25*b* and 26*b* of the connection terminals 25 and 26 for connecting the indicator to the switch unit 1 project from the indication unit 1, the indication unit 1 can function as an indication lamp. Thus the push button switch in accordance with the present invention is convenient in use.

According to the first embodiment, as shown in FIG. 2, the end portion 35*a* of the locking wire is pivotally mounted on the base 8 and the leaf spring 38 which presses the end portion 35*a* of the locking wire 35 under pressure is accommodated in the case 3. Owing to this construction, the insulating distance between the control panel (M) and the switch unit 2 is insured and a compact push button switch can be manufactured. Further, the length of the screw portion 3c can be set as desired.

SECOND EMBODIMENT

Figures 11, 11A:
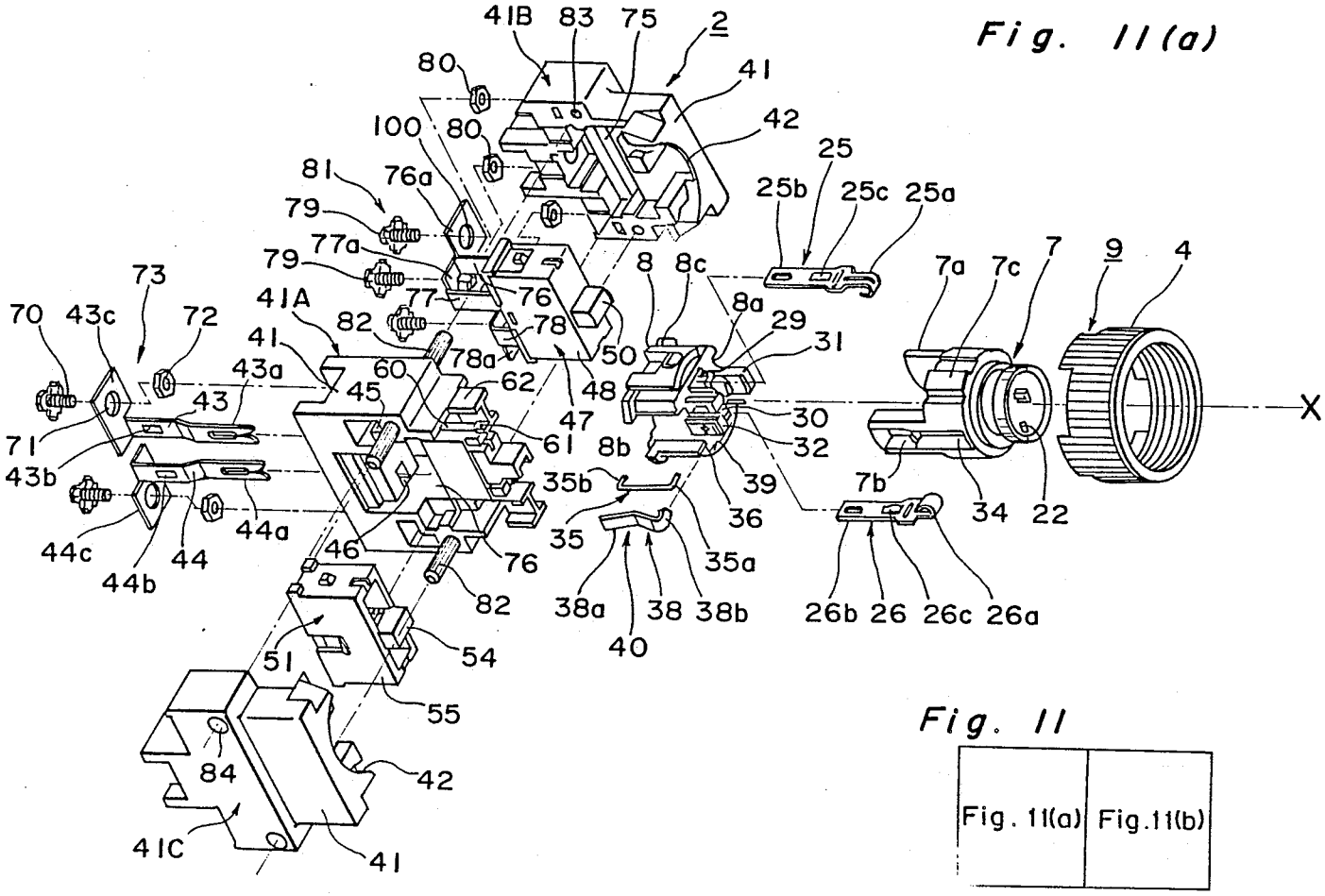
FIG. 11 is a perspective view showing a second embodiment of a light emitting type push button switch in accordance with the present invention.
Figure 11B:
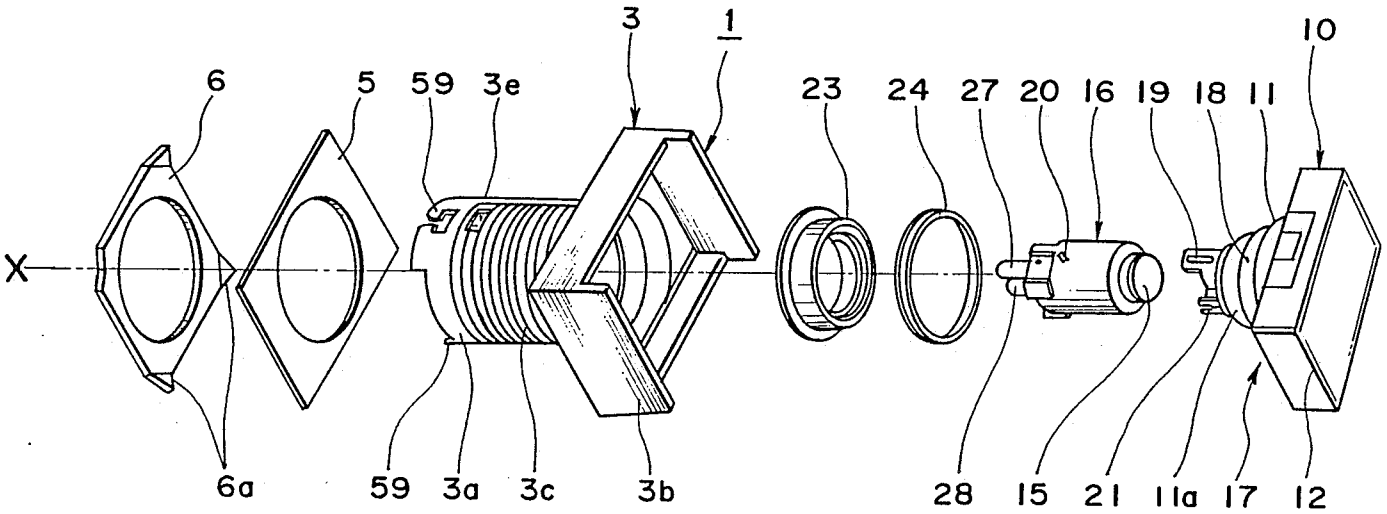

FIG. 11 is an exploded perspective view showing a second embodiment of a light emitting type push button switch in accordance with the present invention.

Parts shown in the drawings of the second embodiment and corresponding to those of the first embodiment are designated by the same reference numerals and the descriptions thereof are omitted.

Figure 12:
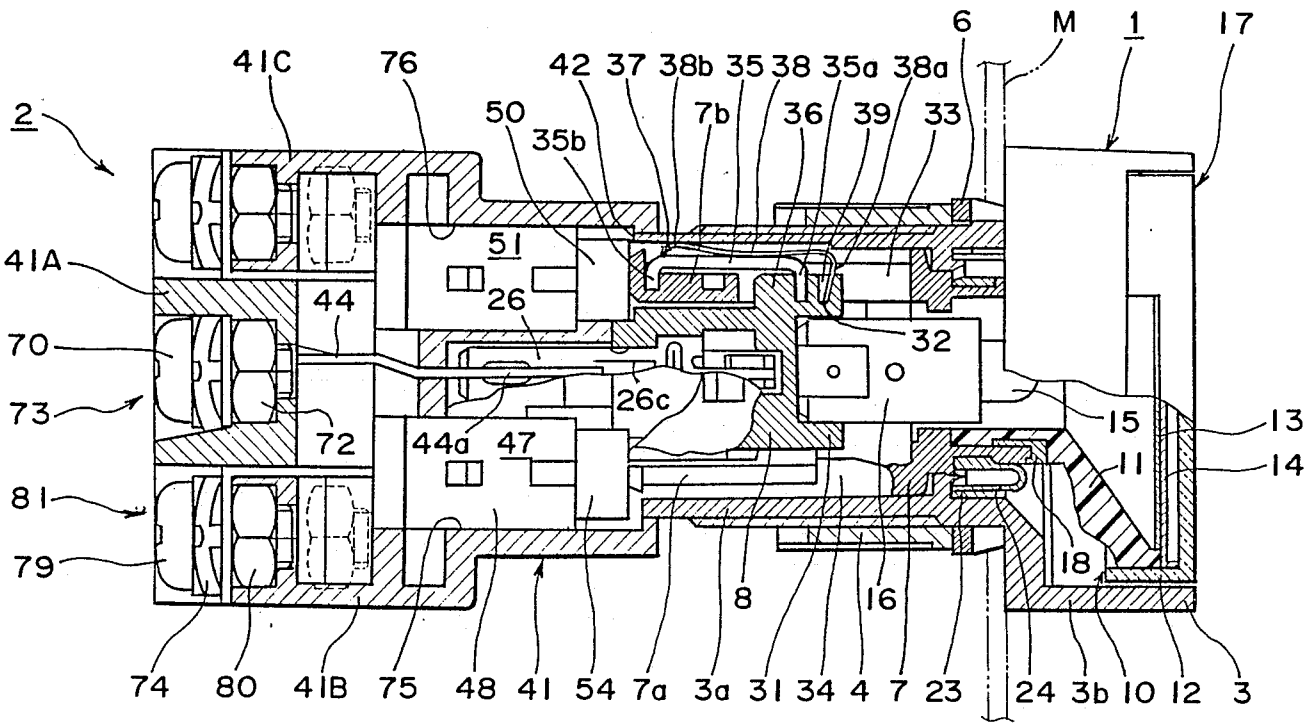
FIG. 12 is a partly broken front view showing the light emitting type push button switch.

Similarly to the switch of the first embodiment, the switch in accordance with the second embodiment comprises an indication unit 1 and a switch unit 2. Since the parts from a case 3 through projections 31 and 32 correspond to those in accordance with the first embodiment, the descriptions thereof are omitted. Referring to FIGS. 11 and 12, one end 35a of a ]-shaped locking wire 35 is pivotally mounted in a small opening 36 formed on the projection 32 of a base 8 and the other end 35b thereof moves around a cam portion 37 formed on the operation leg 7b of a plunger 7, thus performing the known alternate operation. The base portion 38a of a leaf spring 38 is locked by the small opening 39 of the projection 32 and the front end portion 38b thereof is brought in contact with the inner surface of the case 3 so as to elastically bring the end portion 35a of the locking wire 35 in contact with the base 8. Thus, the end portion 35a of the locking wire 35 is prevented from being pulled out of the small opening 36 of the projection 32. The alternate mechanism 40 comprises the locking wire 35 and the cam portion 37.

A switch base 41A is made of a synthetic resin and switch covers 41B and 41C are connected to both sides thereof, thus constituting a box-shaped switch case 41 as shown in FIG. 12. That is, a concave portion 42 in which the base 8 is fitted is formed on a box-shaped switch cover 41 when the switch unit 2 and the indication unit 1 are connected to each other. A pair of external terminals 43 and 44 for connecting the indicator to the switch unit 2 are fixed under pressure to terminal inserting openings 45 and 46 formed on the bottom surface of the concave portion 42. Connection terminals 25 and 26 are inserted into forked socket portions 43a and 44a disposed on the front ends of the external terminals 43 and 44, respectively. Engaging portions 43b and 44b of the external terminals 43 and 44 are locked by the terminal inserting openings 45 and 46, respectively so that the external terminals 43 and 44 are not pulled out of the terminal inserting openings 45 and 46.

The rear end portions 43c and 44c of the respective external terminals 43 and 44 are bent. An inserting opening 71 is formed on the bent portions 43c and 44c. Each inserting opening 71 is provided with a nut 72 into which a male screw 70 is screwed. Thus the male screw 70 and the nut 72 constitute a screw terminal portion 73.

Figure 13:
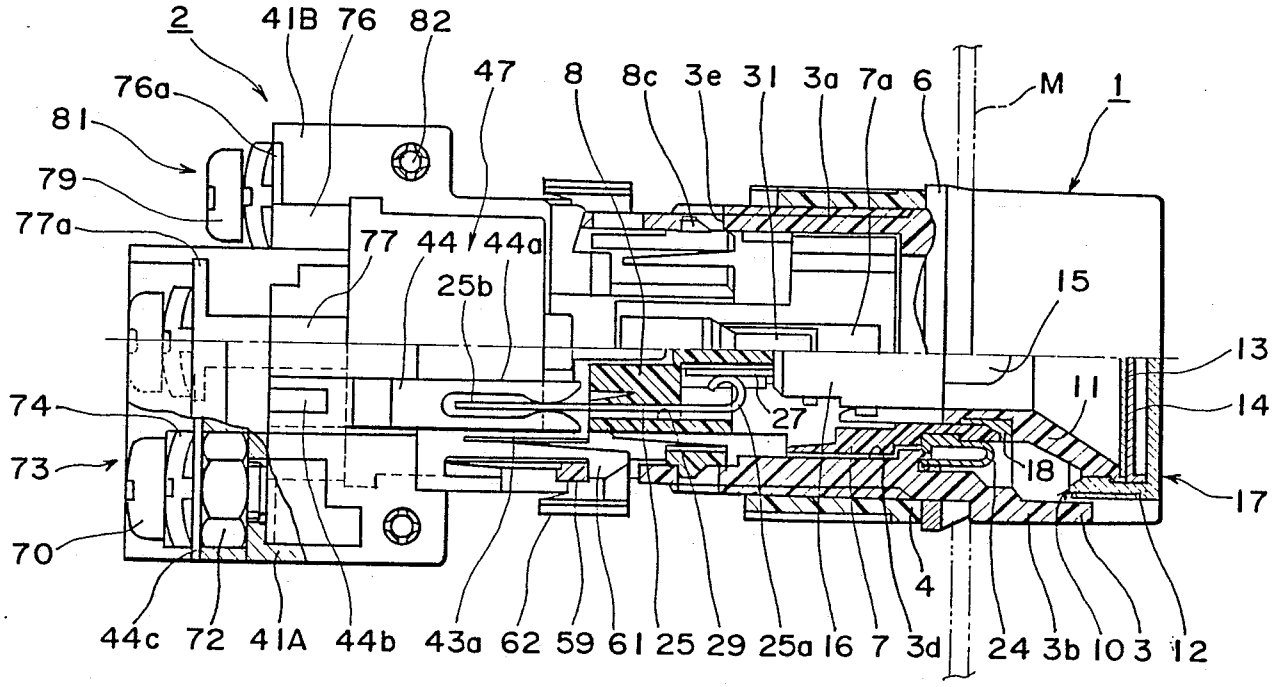
FIG. 13 is a partly broken side elevational view showing the light emitting type push button switch.

The body 48 of a microswitch 47 is accommodated in a concave portion 75 formed in the switch cover 41B. External terminals 76, 77, and 78 extend from the bottom face of the body 48 and the rear ends thereof 76a, 77a, and 78a are bent. An inserting opening 100 into which a male screw 79 is inserted is formed on each of the bent portions 76a, 77a, and 78a, thus the male screw 79 and a female screw 80 in which the male screw is screwed constituting a screw terminal portion 81. The screw terminal portions 73 and 81 may be constituted through the washer 74 as shown in FIGS. 12 and 13.

The microswitch 47 is accommodated both in the base 41A and the concave portion 75 formed on the switch cover 41B. One of pins 82 projecting from both sides of the switch base 41A is fixedly inserted under pressure into an opening 83 formed on the switch cover 41B, whereby the switch base 41A, the switch cover 41B, and the microswitch 47 are connected to each other. An operation lever 50 of the microswitch 47 is driven by the operation leg 7a of the plunger 7.

As shown in FIG. 7 of the first embodiment, the operation lever 54 of a dummy switch 51 is elastically supported by a coil spring 56 accommodated in the case 55. The resilience of the coil spring 56 is approximately the same as that of the spring accommodated in the microswitch 47. Spring seats 57 and 58 are mounted in the operation lever 54 and the case 55, respectively.

The dummy switch 51 is accommodated both in the base 41A and the concave portion 75 formed in the switch cover 41C. The other of the pins 82 projectingly formed on both sides of the base 41A is fixedly inserted under pressure into the opening 84 of the switch cover 41C, whereby the switch base 41A, the switch cover 41C, and the dummy switch 51 are connected to each other.

An operation lever 54 formed on the dummy switch 51 is driven by the operation leg 7b of the plunger 7.

The switch unit 2 comprises the switch case 41, the microswitch 47, and the dummy switch 51.

Figure 14A:
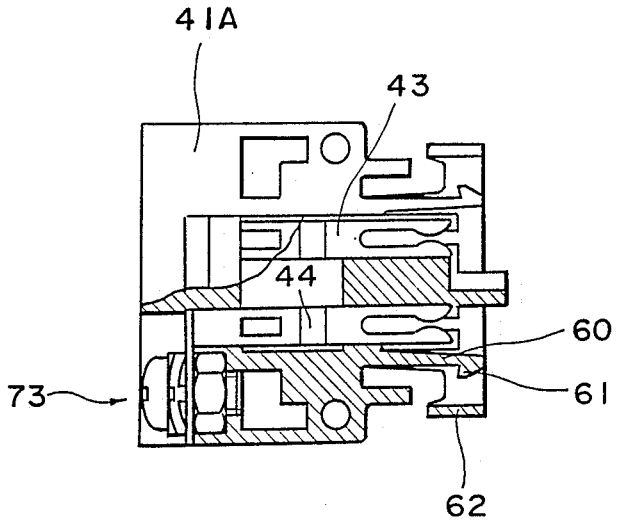
FIGS. 14(A) and 14(B) are a plan view and a front view showing the switch case composing the switch unit of the light emitting type push button switch.
Figure 14B:
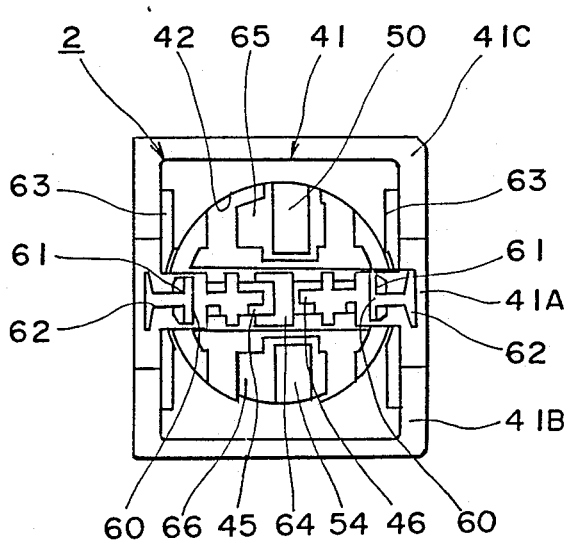

As shown in FIGS. 4(A) and 4(B) of the first embodiment, in the indication unit 1, two approximately C-shaped engaging projections 59 and 59 are formed on the peripheral face of the drum portion 3a of the case 3 so that the engaging projections 59 and 59 are symmetrical with respect to the center of the circle corresponding to the circumference of the drum portion 3a. Referring to FIGS. 13 and 14, elastic arms 60 are formed on the switch case 41 from the rear end thereof to the front end thereof. As shown in FIG. 6 of the first embodiment, a locking projection 61 disposed on the front end of each of the elastic arms 60 removably engages with the inner surface of the engaging projection 59. Further, a T-shaped pressure applying plate 62 is integrated with the front end of the locking projection 61. As shown in FIGS. 14(A) and 14(B), rectangular plates 63 are formed on both sides of the pressure applying plate 62 and on the peripheral surfaces of the switch cover 41.

A base positioning wall 64 shown in FIG. 14(B) is projectingly formed in the concave portion 42 of the switch case 41. The operation levers 50 and 54 are disposed in the openings 65 and 66, respectively formed in the concave portion 42. The openings 65 and 66 allow the movements of the operation legs 7a and 7b of the plunger 7 so as to press the operation levers 50 and 54 under pressure.

The operation of the light emitting type push button switch having the above-described construction is described hereinbelow.

The ON/OFF operation of the microswitch 47 to be performed by the pushing of the push button 10 is the same as that of the known microswitch.

That is, the pushing of the push button 10 drives the plunger 7 in the axial direction thereof, with the result that the microswitch 47 and the dummy switch 51 are pushed by the operation legs 7a and 7b, respectively and the microswitch 47 is turned on (off). At this time, the movement of the operation leg 7a of the plunger 7 displaces the end portion 35b of the locking wire 35 from the pushed position to the push-releasing position at which the end portion 35b is locked by the cam portion 37. As a result, the microswitch 47 is maintained to be ON (OFF).

When the push button 10 is pushed again, the end portion 35b of the locking wire 35 is dislocated from the push-releasing position, thus moving around the cam portion 37. As a result, the microswitch 47 is turned off (on) and the plunger 7 is returned to the original position by the returning force of the operation lever 50. That is, every time the push button 10 is pushed, the microcomputer 47 is turned on or off according to the alternate movement of the locking wire 35.

As apparent from the above description, the switch case 41 comprises three components, namely, the base 41A, and the switch covers 41B and 41C as shown in FIG. 11. Therefore, the base 41A, and the switch covers 41B and 41C can be easily molded.

That is, a pair of the elastic arms 60 is projectingly formed on the base 41A of the switch case 41 constituting the switch unit 2, and the engaging projection 59 of the case 3 constituting the indication unit 1 removably engages with the locking projection 61 of the elastic arm 60 as shown in FIG. 6 of the first embodiment, whereby the indication unit 1 and the switch unit 2 are connected to each other.

The engagement of the engaging projection 59 and the locking projection 61 is released when the T-shaped pressure applying plate 62 is pressed inwards, whereby the indication unit 1 and the switch unit 2 are disengaged from each other.

As described above, a pair of the elastic arms 60 is formed on the base 41A, the engaging projection 59 is formed on the cylindrical drum 3a of the case 3, the concave portions 75 and 75 which accommodate the microswitch 47 and the dummy switch 51, respectively are formed in the switch covers 41B and 41C which are individually formed and connected with the base 41A. Accordingly, the base 41A, the switch covers 41B and 41C can be easily molded. Thus, the switch case 41 containing the microswitch 47 and the dummy switch 51 can be easily assembled.

The external terminals 76, 77, and 78 of the microswitch 47 are formed by punching a flat plate and the terminal portion 81 provided with a screw is formed on the bent portions 76a, 77a, and 78a. As described above, the external terminals 76, 77, and 78 of the microswitch 47 are made of plates. As such, frames formed by punching the plate is placed in a mold, then a resin is poured into the mold. The molded external terminals 76, 77, and 78 are bent to be L-shaped. Thereafter, the female screw 80 and the male screw 79 are inserted through the opening 100 formed on the bent portions 76a, 77a, and 78a, then the male screw 79 is screwed into the female screw 80, whereby the microswitch 47 provided with the screw terminal portion 81 is constructed and the screw terminal portion 81 is fixed to the outer wall of the switch cover 41B.

The connection terminals 25 and 26 fixed to the base 8 of the indication unit 1 are inserted into the forked socket portions 43a and 44a of the respective external terminals 43 and 44, for connecting the indicator to the switch unit 2, fixed to the base 41A of the switch case 41. Thus, the indication unit 1 and the switch unit 2 are connected to each other.

The external terminals 43 and 44 for connecting the indicator to the switch unit 2 are fixed to the base 41A of the switch case 41. The male screw 70 is inserted through the inserting opening 71 formed in each of the bent portions 43c and 44c of the external ends of the external terminals 43 and 44, and is screwed into nut 72. Thus, the base 41A of the switch case 41 on which the terminal portion 73 provided can be easily constructed.

According to the second embodiment, substantially the same load is applied to the dummy switch 51 and the microswitch 47 in operation. This is the reason the dummy switch 51 is disposed alongside of the microswitch 47. Accordingly, even though the center of the push button 10 is not pushed, the microswitch 47 can be favorably operated.

Figure 15:
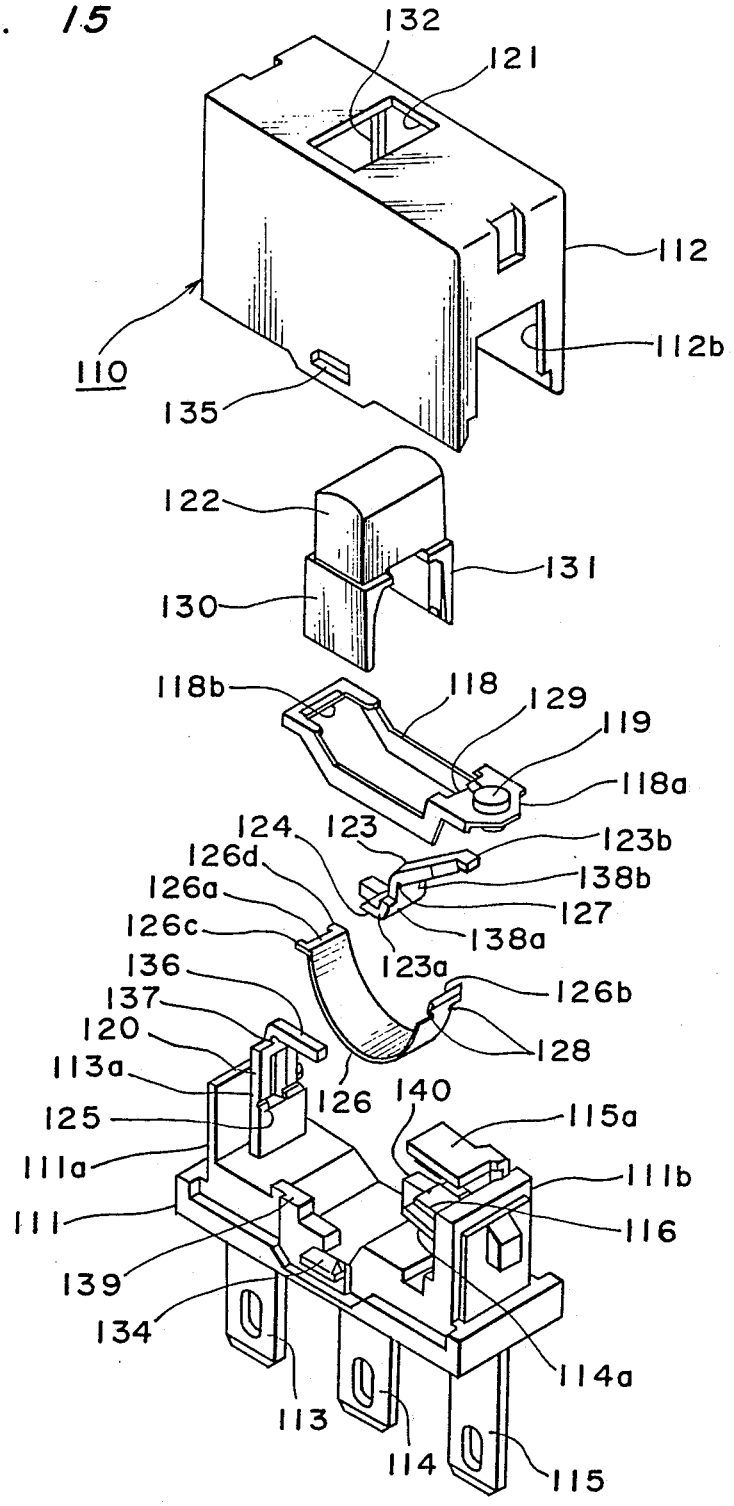
FIG. 15 is a perspective view showing an embodiment of a microswitch in accordance with the present invention.

FIG. 15 is an exploded perspective view showing one embodiment of the microswitch in accordance with the present invention. FIGS. 16(A), 16(B), and 16(C) are sectional views showing the microswitch in different conditions.

Referring to FIGS. 15, 16(A), 16(B), and 16(C), the switch case 110 comprises a plate-shaped terminal base 111 made of an electric insulating synthetic resin and a cover 112, made of a synthetic resin, which is fitted over the terminal base 111. The terminal base 111 constituting the lower wall of the switch case 110 comprises walls 111a and 111b disposed on the left and right sides thereof, respectively. The cover 112 has notches 112a and 112b which engage with the walls 111a and 111b, respectively.

A common terminal plate 113, a closed-fixed terminal 114, and an opened-fixed terminal 115 are mounted on the terminal base 111. In detail, the closed-fixed terminal 114 is closed in a normal condition. The opened-fixed terminal 115 is opened in a normal condition. The inner end portions 114a and 115a of the fixed terminals 114 and 115 are bent to vertically confront each other on the right side of the terminal base 111, and fixed contacts 116 and 117 are fixed to the inner end portions 114a and 115a, respectively. A movable conductive plate 118 in approximately a rectangular shape has a free end portion 118a, including a right connecting portion, to which a movable contact 119 which confronts the fixed contacts 116 and 117 is fixed. The movable conductive plate 118 has also a base end portion 118b, including a left connecting portion, which is pivotally mounted in a first groove 120 formed on the left side face of the inner portion 113a of the common terminal 113.

Figure 16:
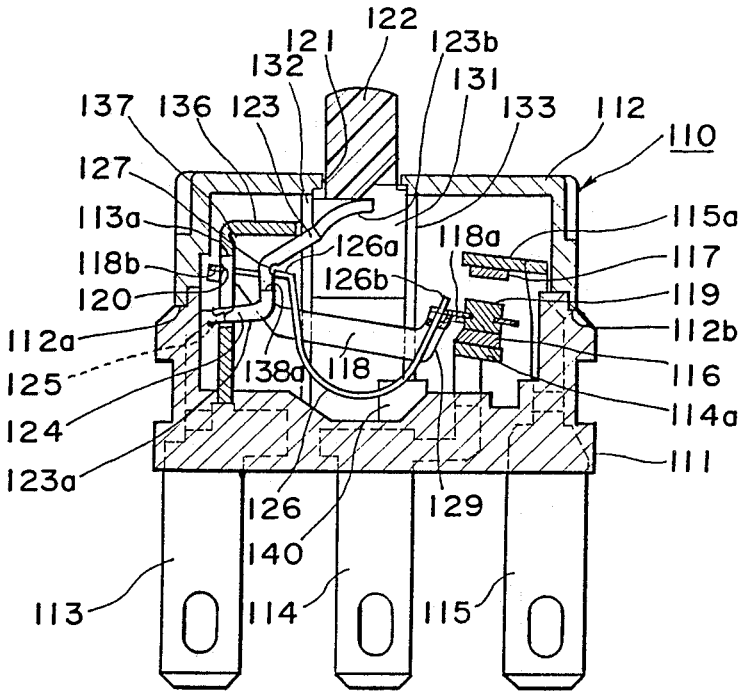
FIGS. 16(A), (B), and (C) are sectional views showing the microswitch in different conditions.
Figure 16:
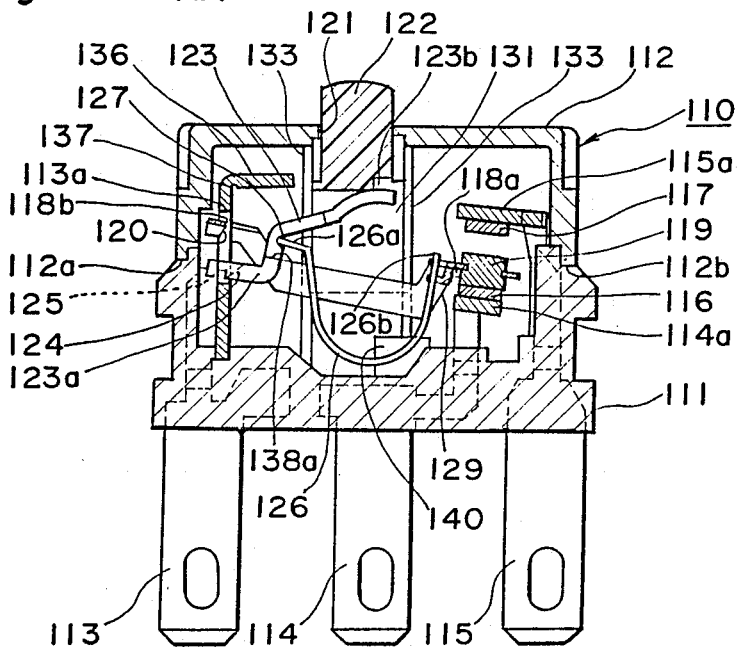
Figure 16C:
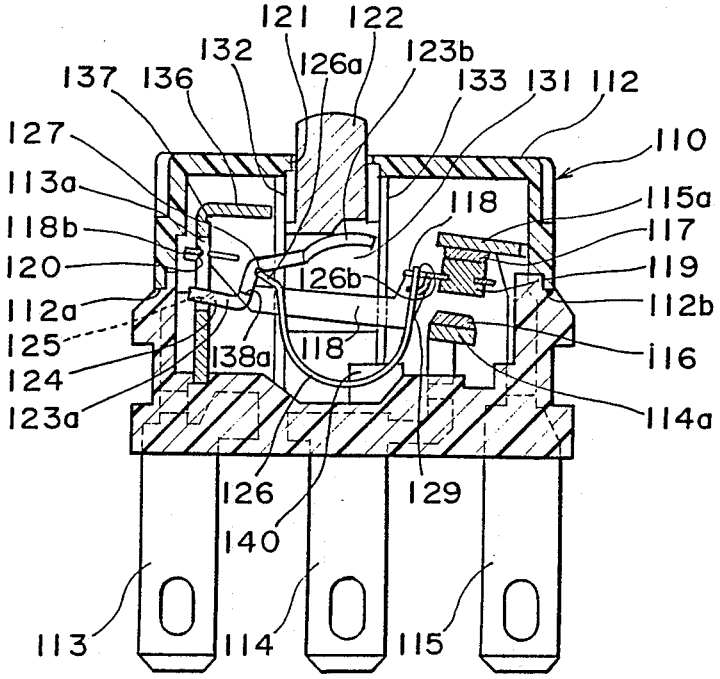
Figure 17:
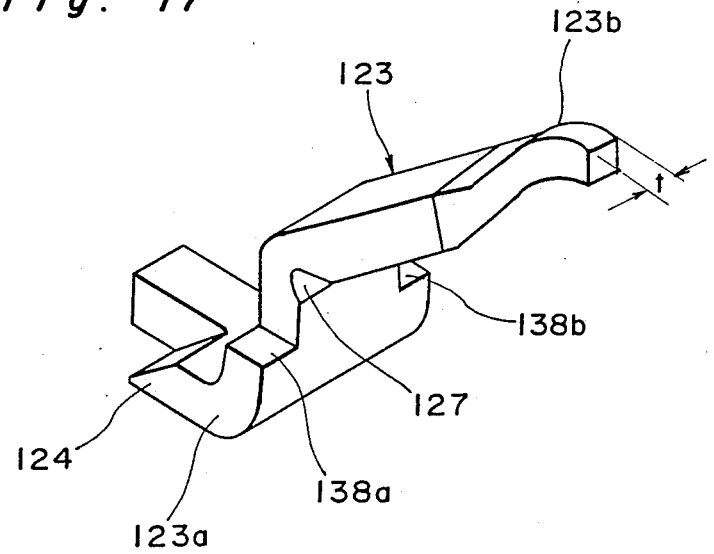
FIG. 17 is a perspective view showing the lever of the microswitch.

Referring to FIG. 16, a rectangular opening 121 is formed on the upper wall of the cover 112 and between the inner end portion 113a of the common terminal 113 and a pair of the inner end portion 114a of the closed-fixed terminal 114 as well as the inner end portion 115a of the opened-fixed terminal 115. A push button 122 made of a synthetic resin is vertically movably inserted into the opening 121. As shown in FIG. 17, an edge portion 124 formed in the vicinity of the base portion 123a of an approximately S-shaped lever is pivotally mounted in a second groove 125 formed on the right side face of the inner end portion 113a of the common terminal 113, and the free end portion 123b is driven by the bottom surface of the push button 122. The left end portion 126a of an approximately U-shaped compression spring 126 comprising a leaf spring engages with a groove 127 formed on the right side face of the center of the lever 123 and as shown in FIG. 18 (A), notches 128 and 128 formed on the right end portion 126b of the compression spring 126 engage with projections 129 and 129 formed on the free end portion 118a of the movable plate 118, thus applying a returning force to the movable plate 118.

A pair of regulating plates 130 and 131 formed on the lower end of the push button 122 regulates the position of the movable plate 118 in the widthwise direction thereof. Projected rails 132 and 133 which guide the regulating plates 130 and 131 are formed on the front and rear walls inside the cover 112.

Referring to FIG. 15, projections 134 and 134 formed on the front and rear end portions of the terminal base 111 engage with openings 135 and 135 formed on the front and rear walls of the cover 112, whereby the terminal base 111 and the cover 112 are connected to each other.

A lever positioning projection 136 which extends from the common terminal plate 113 and is bent toward the leer 123 displaces the free end portion **123*b* of the lever 123 to the position at which the push button 122 can be set. As described above, the left end portion 126*a* of the compression spring 126 is pivotally mounted on the free end portion 123*b* of the lever 123. A concave portion 137 is formed on the inner portion 113*a* of the common terminal plate 113 so that the lever positioning projection 136** can be bent.

As shown in FIG. 17, shoulders **138*a* and 138*b* are formed on both sides of the lever 123 and near the lower portions thereof. The shoulders 138*a* and 138*b* serve as means for receiving the projections 126*c* and 126*d* of the left end portion 126*a* formed on the compression spring 126 when the left end portion 126*a* disengages from the groove 127 in assembling the microswitch. As shown in FIG. 17, the width (t) of the free end portion 123*b* of the lever 123 is smaller than the other portions of the lever 123 and circular so that the change in the load to be applied to the lever 123** is small.

The terminal base 111 has vertical stoppers 139 and 140, formed on both sides of the upper surface thereof, which contact with the lower end portions of the regulating plates 130 and 131 when the push button 122 is pushed to the top of its stroke, thus regulating the movement amount of the push button 122. In this embodiment, the stoppers 139 and 140 are longitudinally shifted from each other.

The method for assembling the principal portions of the microswitch is described hereinbelow referring to FIGS. 18(A) and 18(B).

Figure 18A:
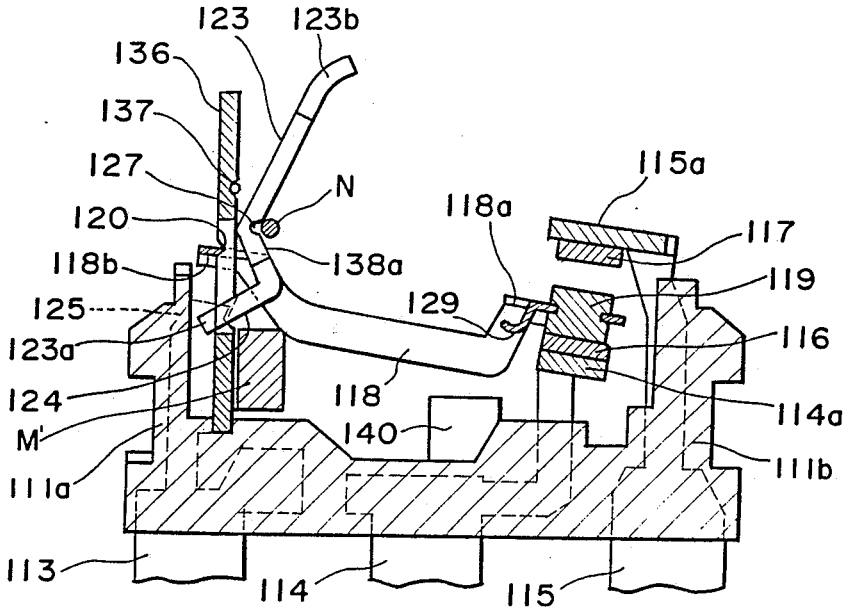
FIGS. 18(A) and 18(B) are explanatory views for explaining the assembling of the principal portions of the microswitch.
Figure 18B:
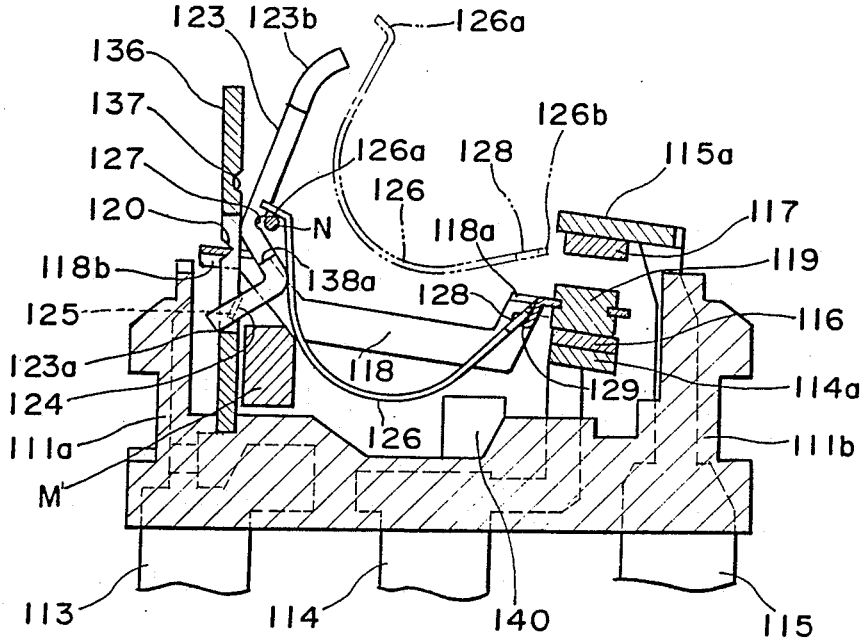

Referring to FIG. 18(A), the base portion **118*b* of the movable plate 118 is pivotally mounted on the first groove 120 of the common terminal 113 with the movable plate 118 supported by means of a tool (M). Then, the edge portion 124 of the lever 123 is pivotally mounted on the second groove 125 by vertically supporting the lever 123 by means of a tool (N) with the lever 123 standing erect, and then, as shown in FIG. 18 (B), the notch 128 disposed on the right end portion of the compression spring 126 is engaged by the engaging projection 129 disposed near the free end portion 118*a* of the movable plate 118, and the left end portion 126*a* of the compression spring 126 is brought into contact with the right side face of the lever 123 with the compression spring 126 supported by the tool (N). Thereafter, the lever 123 is rotated clockwise about the second groove 125 in this state, with the result that the left end portion 126*a* of the compression spring 126 falls into the groove 127. Thus, the compression spring 126 is locked by the lever 123**.

The operation of the microswitch having the above-described construction is described hereinbelow.

When the push button 122 positioned as shown in FIG. 16(A) is pushed, the lever 123 pivots clockwise about the edge portion 124 (125) disposed on the base portion side thereof. As a result, the left end portion **126*a* (127) of the compression spring 126 is circularly displaced downwards, i.e, the left end portion 126*a* (127) is rotated clockwise about the edge portion 124 (125) of the lever 123, and the compression spring 126 is deformed as shown in FIG. 16(B). When the left end portion 126*a* (127) of the compression spring 126 is further pivoted clockwise beyond the change point corresponding to the height of the base end portion 118*b* (120) as a result of the further pushing of the push button 122, the compression spring 126 is released and free end portion 118*a* of the movable plate 118 rotates counterclockwise about the base end portion 118*b* (120). Consequently, as shown in FIG. 16(C), the movable contact 119 becomes out of contact with the fixed contact 116 and is brought in contact with the fixed contact 117, with the result that the opened-fixed terminal plate 115 and the common terminal plate 113** become closed.

When the push button 122 is released in the state as shown in FIG. 16(C), the lever 123 rotates counterclockwise. As a result, opposite to the above-described operation, the movable contact 119 returns to the original position as shown in FIG. 16(A). Consequently, the closedfixed terminal 114 and the common terminal plate 113 become closed.

According to the above-described construction, since the force applied to the push button 122 is transmitted to the movable plate 118 through the lever 123 and the compression spring 126, the stroke of the push button 122 is increased to as long as approximately 3mm by the lever 123. Therefore, the microswitch can be easily automatically assembled.

Supposing that, in assembling the microswitch, the left end portion **126*a* of the compression spring 126 does not fall into the groove 127 of the lever 123 when the lever 123 is rotated clockwise after the left end portion 126*a* of the compression spring 126 is brought in contact with the right side face of the lever 123, the projections 126*c* and 126*d* of the left end portion 126*a* of the compression spring 126 are received by the shoulders 138*a* and 138*b*. Thus, the compression spring 126 can be prevented from falling downward from the lever 123. As such, the compression spring 126** can be reliably assembled.

Even though the left end portion **126*a* of the compression spring 126 disengages from the groove 127 due to a vibration or a shock imparted to the microswitch in use, the left end portion 126*a* of the compression spring 126 can be prevented from falling out of the lever 123**.

Figure 19:
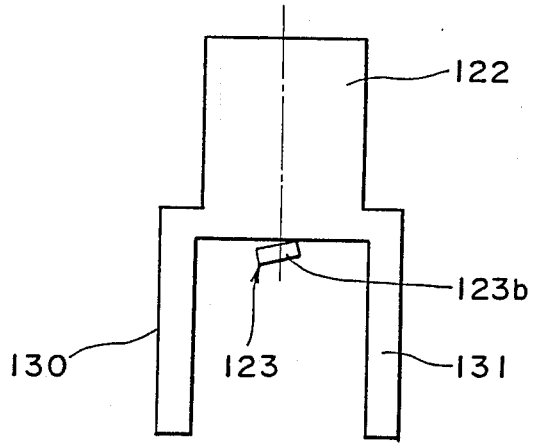
FIG. 19 is an explanatory view for explaining the condition of the push button and the lever of the microswitch in which the push button and the pivotal lever contact with each other.

Should the lever 123 tilt widthwise, the free end portion **123*b* thereof would still contact the push button 122 in approximately the center thereof as shown in FIG. 19 because the width (t) of the free end portion 123*b* of the lever 123 is smaller than the other portions thereof as shown in FIG. 17. That is, the force is applied to the push button 122 by the lever 123 at approximately the center thereof. Therefore, the push button 122** can be prevented from rotating, i.e., the push button can be reliably pushed.

If a force such as a vibration or a shock is applied to the push button 122 when it has been pushed beyond the top of its stroke, the push button 122 penetrates into the cover 112.

Figure 20:
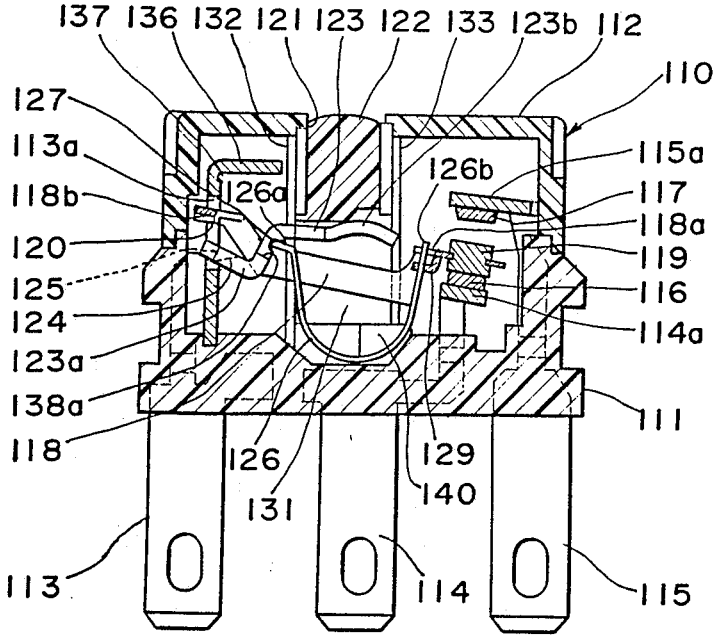
FIG. 20 is a sectional view showing the microswitch in which the push button is pushed to the top of its stroke.
Figure 21:
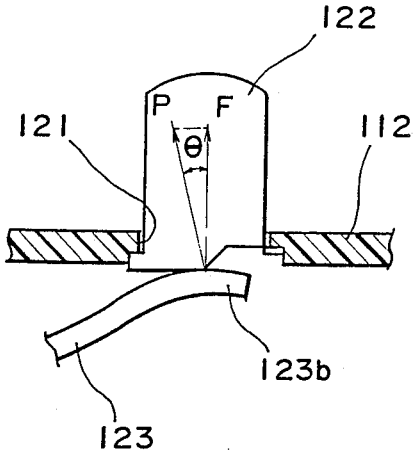
FIG. 21 is an explanatory view for explaining the condition of the push button and the lever of the microswitch in which the push button and the free end portion of the lever contact with each other.

As described previously, the stoppers 139 and 140 are formed on the top surface of the lower wall 111 so as to confront the pair of regulating plates 130 and 131, each other formed below the push button 122. Owing to this construction, when the push button 122 is pushed to the top of its stroke, the lower ends of the regulating plates 130 and 131 contact with the stoppers 139 and 140, respectively. Accordingly, as shown in FIG. 20, the push button 122 is prevented from being pushed beyond its top of its stroke, i.e., the push button 122 is not pushed into the cover 112. As such, the push button 122 can be reliably returned to its original position.

Further, the stoppers 139 and 140 strengthen the thin portion of the lower wall 111 into which the common terminal 113, the closed-fixed terminal 114, and the opened-fixed terminal 115 are inserted by molding. The stoppers 139 and 140 may be formed to confront each other or shifted from each other as shown in FIG. 15.

It is to be noted that various changes and modifications of the configurations and positions of the stoppers 139 and 140 are apparent to those skilled in the art.

Supposing that the angle formed by the normal line at the contact point of the free end portion **123*b* of the lever 123 with the bottom surface of the push button 122 with respect to the direction in which force is applied to the push button 122 is $\theta$ and the force which the lever 123 applies to the push button 122 is P, the force (F) for operating the push button 122** is expressed as follows:

$$F = P\cos\theta$$

The touch of the push button 122 is preferable when the change in the load of pushing the push button 122 from the initial condition as shown in FIG. 16(A) until the condition in which the push button 122 is operated as shown in FIG. 16(B) is small.

Figure 22:
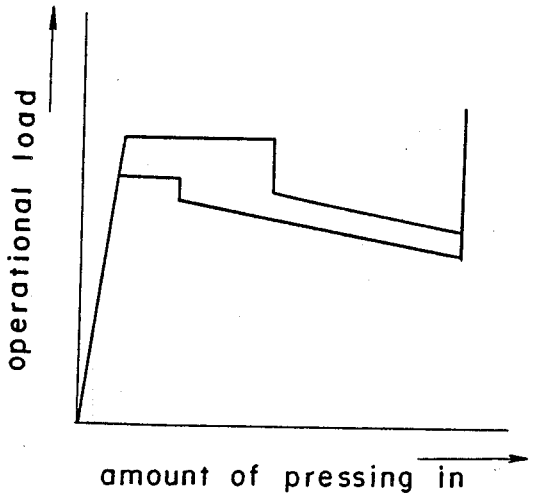
FIG. 22 is a characteristic view showing the relationship between the push amount of the push button and the load of operating the push button of the microswitch.
Figure 23:
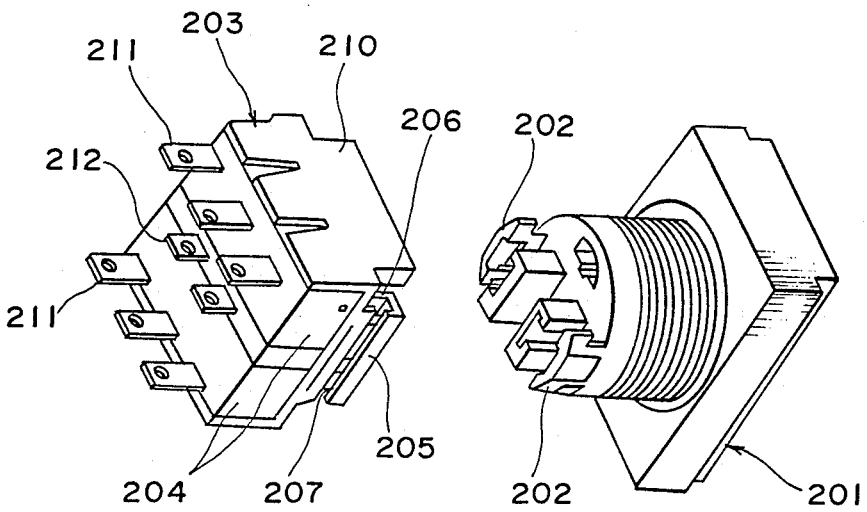
Fig. 23 PRIOR ART
FIG. 23 is a perspective view showing a known light emitting type push button switch in which the indication unit and the switch unit are disconnected from each other.
Figure 24:
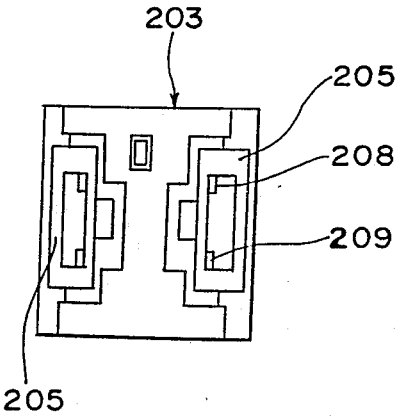
Fig. 24 PRIOR ART
FIG. 24 is a front view of the switch unit shown in FIG. 23.
Figure 25:
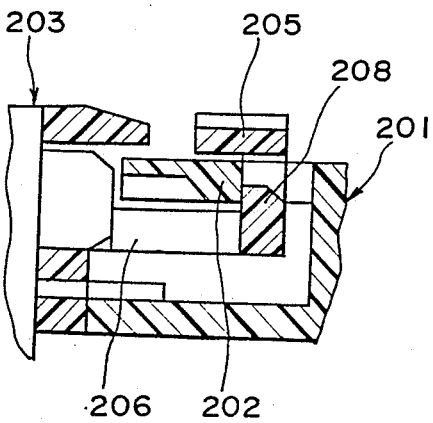
Fig. 25 PRIOR ART
FIG. 25 is a sectional view showing the connected portion of the indication unit and the switch unit shown in FIG. 23.

According to this embodiment, the portion of the free end portion **123*b* which contacts with the push button 122 is circular, so that the angle $\theta$ becomes greater till the condition in which the push button 122 is operated as shown in FIG. 16(B). Accordingly, the change in the load of pushing the push button 122 from the initial condition until the condition in which the push button 122 is operated is small. The relationship between the amount of the pushing of the push button 122 and the load of operating the push button 122 is as shown in FIG. 22. Thus, a preferable touch of the push button 122** can be obtained.

What is claimed is:

1. A light emitting type such button switch comprising:

an indication unit having a base, a case and an operation block containing an indicator;

a switch unit having a switch cover and a microswitch, wherein one end of said switch cover is removably connected to a rear end portion of said indication unit;

a plunger axially movably held in the case of said indication unit and moveable in response to a pushing movement of said operation block, wherein said microswitch is switched by movement of said plunger;

a plurality of approximately O-shaped engaging projections formed on the rear end portion of said indication unit;

a plurality of elastic arms formed integrally with the switch cover of said switch unit so as to correspond to said engaging projections, wherein said plurality of elastic arms extend to said one end of said switch cover from the other end of said switch cover;

locking projection means formed on the distal end of each of said elastic arms for removably engaging an inner surface of the corresponding said engaging projection; and disengaging means for disengaging said locking projection means from said inner surface of said corresponding engaging projection upon application of pressure thereto in an inward radial direction, wherein said disengaging means comprises a T-shaped disengaging pressure applying plate formed on the peripheral surface of the locking projection.

2. A light emitting type push button switch as claimed in claim 1, wherein a dummy switch having a load substantially equal to a load of said microswitch is provided alongside said microswitch.

3. A light emitting type push button switch as claimed in claim 2, wherein said base of said indicator unit comprises a pair of longitudinally disposed indicator connecting terminals fixed thereto, wherein each of said indicator connecting terminal has a conductive leaf spring formed on an inner portion thereof which curvedly extends to and contacts with a corresponding one of a pair of lead terminals of said indicator.

4. A light emitting type push button switch as claimed in claim 3, further comprising alternate locking means for alternately locking and unlocking relative movement between the plunger and the base of said indication unit and further comprising a leaf spring, wherein said alternate locking means comprises a locking wire which is pivotally mounted at one end thereof to said plunger and which communicates with said base at the other end thereof, wherein said leaf spring presses said other end of said locking wire toward said base and is mounted on an inner circumferential face of the case of said indication unit.

5. A light emitting type push button switch as claimed in claim 2, further comprising alternate locking means for alternately locking and unlocking relative movement between the plunger and the base of said indication unit and further comprising a leaf spring, wherein said alternate locking means comprises a locking wire which is pivotally mounted at one end thereof to said plunger and which communicates with said base at the other end thereof, wherein said leaf spring presses said other end of said locking wire toward said base and is mounted on an inner circumferential face of the case of said indication unit.

6. A light emitting type push button switch as claimed in claim 1, wherein said base of said indicator unit comprises a pair of longitudinally disposed indicator connecting terminals fixed thereto, wherein each said indicator connecting terminal has a conductive leaf spring formed on an inner portion thereof which curvedly extends to and contacts with a corresponding one of a pair of lead terminals of said indicator.

7. A light emitting type push button switch as claimed in claim 6, further comprising alternate locking means for alternately locking and unlocking relative movement between the plunger and the base of said indication unit and further comprising a leaf spring, wherein said alternate locking means comprises a locking wire which is pivotally mounted at one end thereof to said plunger and which communicates with said base at the other end thereof, wherein said leaf spring presses said other end of said locking wire toward said base and is mounted on an inner circumferential face of the case of said indication unit.

8. A light emitting type push button switch as claimed in claim 1, further comprising alternate locking means for alternately locking and unlocking relative movement between the plunger and the base of said indication unit and further comprising a leaf spring, wherein said alternate locking means comprises a locking wire which is pivotally mounted at one end thereof to said plunger and which communicates with said base at the other end thereof, wherein said leaf spring presses said other end of said locking wire toward said base and is mounted on an inner circumferential face of the case of said indication unit.

* * * * *